US007107643B1

(12) United States Patent
McKay

(10) Patent No.: US 7,107,643 B1
(45) Date of Patent: Sep. 19, 2006

(54) LINT BRUSH WITH PEEL-OFF STRIPS

(75) Inventor: William D. McKay, Grand Blanc, MI (US)

(73) Assignee: The Hartz Mountain Corporation, Secaucus, NJ (US)

( * ) Notice: Subject to any disclaimer, the term of this patent is extended or adjusted under 35 U.S.C. 154(b) by 538 days.

(21) Appl. No.: 10/293,757

(22) Filed: Nov. 13, 2002

Related U.S. Application Data

(60) Provisional application No. 60/413,983, filed on Sep. 26, 2002.

(51) Int. Cl.
*A47L 25/00* (2006.01)

(52) U.S. Cl. ..... 15/104.002

(58) Field of Classification Search ..... 15/104.002
See application file for complete search history.

(56) References Cited

U.S. PATENT DOCUMENTS

| | | | | | |
|---|---|---|---|---|---|
| 2,271,189 | A | | 1/1942 | Garthwait | |
| 2,506,333 | A | | 5/1950 | Bedynek | |
| 2,612,336 | A | | 9/1952 | Tuttle | |
| 2,693,610 | A | * | 11/1954 | Hensley, Jr. | 15/104.002 |
| 2,702,913 | A | * | 3/1955 | Walkama | 15/104.002 |
| 2,708,761 | A | * | 5/1955 | Berquist | 15/104.002 |
| 3,011,499 | A | | 12/1961 | Tajan | 401/139 |
| 3,040,352 | A | * | 6/1962 | Vian | 15/104.002 |
| 3,056,154 | A | | 10/1962 | Neal | 15/104.002 |
| 3,102,544 | A | | 9/1963 | Keegan et al. | 132/147 |
| 3,158,887 | A | | 12/1964 | Kanbar et al. | 15/104.002 |
| 3,299,461 | A | | 1/1967 | Marks | 15/104.002 |
| 3,373,457 | A | | 3/1968 | Rouch, Jr. | 15/104.002 |
| D216,942 | S | | 3/1970 | Safalow | |
| 3,665,543 | A | | 5/1972 | Nappi | 15/215 |
| 3,742,547 | A | | 7/1973 | Sohmer | 15/104.002 |
| D238,127 | S | | 12/1975 | Snyder | |
| 4,062,083 | A | | 12/1977 | McKay | 15/106 |
| 4,107,811 | A | | 8/1978 | Imsande | 15/215 |
| 4,244,587 | A | | 1/1981 | Schweizer | 15/104.8 |
| 4,361,923 | A | | 12/1982 | McKay | 15/104.002 |
| 4,399,579 | A | | 8/1983 | McKay | 15/104.002 |
| 4,422,201 | A | | 12/1983 | McKay | 15/104.002 |
| 4,489,912 | A | | 12/1984 | Haythornthwaite | |
| 4,519,566 | A | | 5/1985 | Manzi | |
| 4,727,616 | A | | 3/1988 | Kucera et al. | 15/104.002 |
| 4,850,073 | A | | 7/1989 | Preuss | 15/207.2 |

(Continued)

FOREIGN PATENT DOCUMENTS

| | | | |
|---|---|---|---|
| JP | 11-216097 | * | 8/1999 |

(Continued)

*Primary Examiner*—Mark Spisich
(74) *Attorney, Agent, or Firm*—Gottlieb, Rackman & Reisman

(57) ABSTRACT

An adhesive tape brush for cleaning fabric includes a handle and a brush head. Multiple cleaning sheets are removably supported on a lower and upper surfaces of the brush head in a separable roll, non-movably fixed on the brush head. When the outermost sheet becomes soiled, the sheet may be peeled away to expose an underlying non-soiled sheet. The brush head is fixed relative to the handle so that the web of sheets is not movable to create a high amount of friction when the outermost sheet is engaged and moved along with a surface. An elongated tape roll refill has perforations in at least one location to allow the roll to be separated into smaller width portions for individual use. Another tape roll refill has a generally nominal circular cross-section, but is deformable to an oblate shape to be mountable on either circular or oblate shaped brush heads.

17 Claims, 4 Drawing Sheets

U.S. PATENT DOCUMENTS

| | | | | |
|---|---|---|---|---|
| 4,905,337 | A | 3/1990 | McKay | 15/104.002 |
| D311,995 | S | 11/1990 | Garcia | |
| D314,282 | S | 2/1991 | Gingras | |
| 5,027,465 | A | 7/1991 | McKay | 15/104.002 |
| D320,680 | S | 10/1991 | Stetson et al. | D30/158 |
| D342,610 | S | 12/1993 | Stetson et al. | D4/122 |
| D363,214 | S | 10/1995 | Parola et al. | D6/521 |
| 5,819,989 | A | 10/1998 | Saraceni | 222/192 |
| 5,878,457 | A | 3/1999 | Cox et al. | 15/104.002 |
| 5,940,921 | A | 8/1999 | Wood et al. | |
| D419,306 | S | 1/2000 | Hansen et al. | |
| 6,014,788 | A | 1/2000 | Jaffri | 15/104.002 |
| 6,055,695 | A | 5/2000 | McKay, Jr. | 15/104.002 |
| 6,127,014 | A | 10/2000 | McKay, Jr. | 428/43 |
| D441,538 | S | 5/2001 | Petner | |
| D446,023 | S | 8/2001 | Sherman | |
| 6,298,517 | B1 | 10/2001 | McKay | 15/228 |
| 6,321,408 | B1 | 11/2001 | Esterson et al. | |
| 6,325,070 | B1 | 12/2001 | Tyroler et al. | 132/112 |
| 6,756,102 | B1 | 6/2004 | Galo | |
| 2002/0144367 | A1 | 10/2002 | McKay, Jr. | |
| 2003/0096074 | A1 | 5/2003 | Kim | |
| 2004/0154133 | A1 | 8/2004 | Polzin et al. | |
| 2004/0194240 | A1 | 10/2004 | McKay, Jr. | |

FOREIGN PATENT DOCUMENTS

| | | | |
|---|---|---|---|
| JP | 2001-37699 | * | 2/2001 |
| JP | 2001-245838 | * | 9/2001 |

* cited by examiner

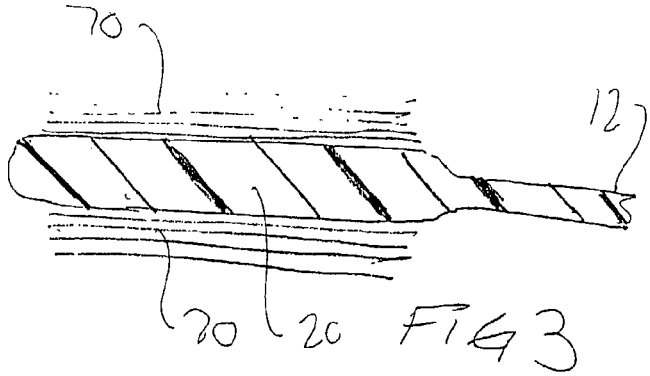
FIG - 1
FIG 3
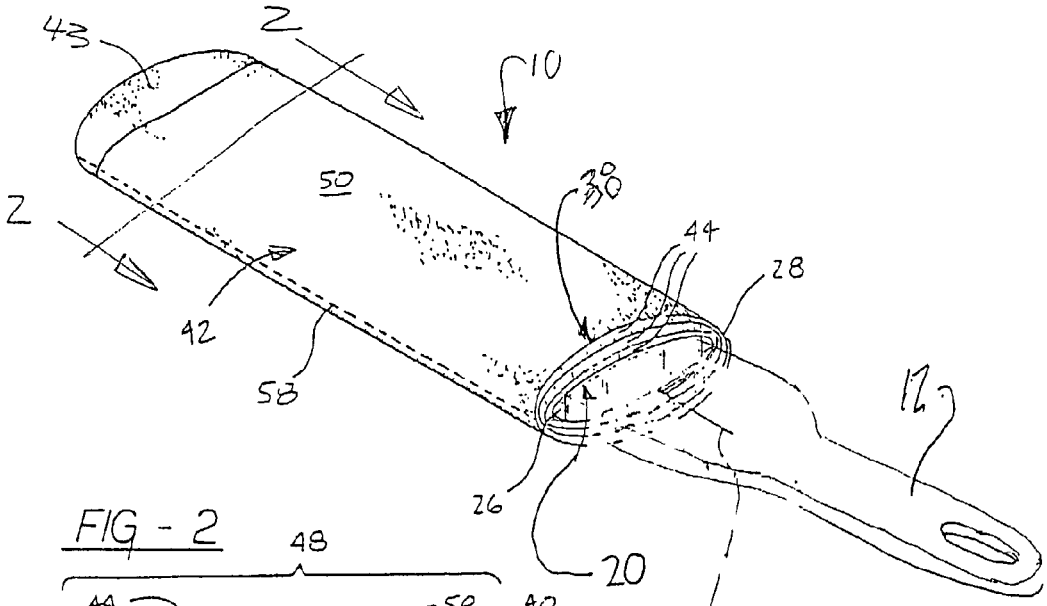
FIG - 2
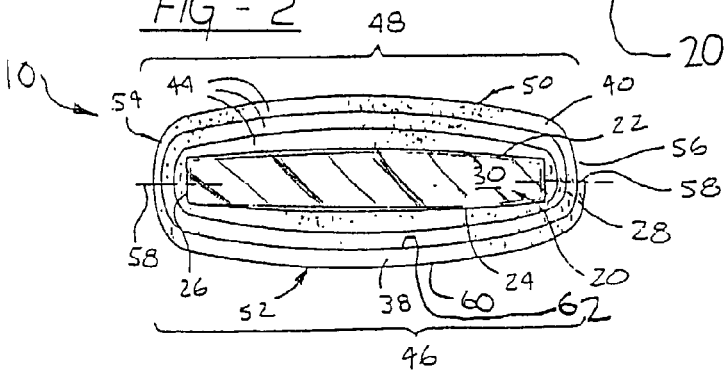
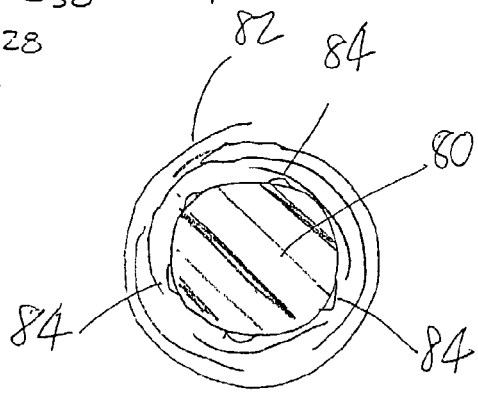
FIG 4

LINT BRUSH WITH PEEL-OFF STRIPS

CROSS REFERENCE TO CO-PENDING APPLICATION

This application claims priority of the Sep. 26, 2002 filing date of provisional patent application Ser. No. 60/413,983, the contents of which are incorporated herein in its entirety.

BACKGROUND

Surfaces such as clothing, pets, furniture and fabrics are most aesthetically pleasing and safe when they are clean, dry, and free of dirt, debris, shed hair and dander. Unfortunately, such surfaces typically become soiled rapidly due to environmental contaminants such as dust and due to the deposit of dirt and debris by people, machines, and pets and by the shedding of hair.

To address these problems, an adhesive tape brush apparatus has been devised which includes a gripping handle. The previously known adhesive tape brush apparatuses known as lint rollers have used a number of different means to rotatably mount the lint roller support to the handle. For example, in U.S. Pat. No. 4,361,923, the lint roller support/handle are separately constructed and then secured together. A disadvantage of this type of lint roller assembly, however, is that the rotatable connection between the handle and lint roller support is subjected to mechanical wear and tear and ultimately mechanical failure. Another disadvantage is that the two pieces require assembly. A still further disadvantage of this type of previously known lint roller assembly is that the lint roller support assembly rotates making it impossible to lock in place for use with directional lint remover fabric or adhesive tape lint removal rolls, which requires a fixed support section to facilitate a brushing motion. Still other types of previously known lint remover assemblies, such as that disclosed in U.S. Pat. No. 6,055,695, have the handle injection molded in two halves which, however, requires expensive and complex molds and assembly, which is slow and expensive and facilitates a rotatably used adhesive tape roll.

While such lint brushes have found widespread effective use in removing hair and debris laying loosely on various surfaces, such lint brushes have proven somewhat deficient at removing hairs, such as animal hairs which are embedded in the fabric. Animal hairs, including cat hairs, frequently become embedded end first in the clothing, upholstery, or drapery fabric. Moving a rollable lint brush across the exposed end of the embedded animal hair does not have sufficient friction to pull the embedded portion of the hair from the fabric. In this case, the lint brush merely rolls over the animal hair and does not remove it from the fabric.

Unidirectional brushes have been provided using a fabric mounted on one end of a handle. Such brushes are drawn in one direction across a fabric or other surface to be cleaned. Since the fabric is placed in a single, non-movable layer about one end of the brush assembly, it typically is capable of developing sufficient friction to remove embedded animal hairs from furniture or other fabrics.

However, cleaning of such unidirectional fabric is difficult since the fabric is tightly and fixedly mounted on the brush and cannot be removed for more convenient cleaning or disposal. Typically, the unidirectional fabric brush is cleaned by brushing it against another fabric or against the user's fingers.

Thus, it would be desirable to provide a lint brush which utilizes a roll of separable outwardly facing adhesive tape sheets which are removable from the roll when the outermost sheet becomes soiled and yet are stationarily affixed relative to the handle so as to develop sufficient friction when moved across a surface being cleaned to remove embedded animal hair from fabric, furniture directly from an animal's coat or other surfaces. It would also be desirable to provide such a lint brush which is capable of employing both a unidirectional fabric and a roll of separable adhesive sheets, either individually or in combination for more widespread application depending upon the cleaning needs of a particular application.

Lint and pet hair tape rollers have refills that are typically sized to fit the roller tool and are sold singularly or in multiple packs or combination packages made of cardboard or shrink wrap film. The problem with these refills is that they are provided in single rolls which require extra handling for packaging.

Thus, it would be desirable to provide a lint and/or pet hair tape roller refill which can be more conveniently packaged for a reduced manufacturing cost.

SUMMARY

The present invention is a lint brush for removing lint and other debris from surfaces, ideally fabric surfaces wherein lint and animal hair tends to become embedded in the fabric with only an end portion projecting from the fabric.

The present lint brush is characterized by a non-rotatable brush head and a roll of lint removing sheets non-rotatably mounted on the brush head.

The fixed positioning of the roll of lint removal sheets on the brush head insures that sufficient friction is developed as the brush head is moved across a surface to be cleaned to pull any embedded lint or animal hair from the fabric.

In one aspect, at least the brush head and, alternately, the roll itself, have a non-circular cross-section, such as an oblate cross-section, to maximize the amount of contact surface between the lint removing sheets on the roll and the surface to be cleaned.

The roll of lint removal sheets is fixedly mounted on the brush head by an interference fit or by projections or other surfaces on the brush head which engage an inner surface of the roll in a high friction manner to resist movement of the roll relative to the brush head during a cleaning operation.

The lint brush of the present invention is capable of generating a sufficiently high friction force on a surface being cleaned to efficiently pull and remove embedded animal hair from a fabric surface as the lint brush is moved across the surface. At the same time, the lint brush of the present invention enables a soiled outmost sheet on the roll mounted on the brush head to be separated from the roll to expose a fresh, unsoiled, underlying sheet for further cleaning operations.

In another aspect, the present invention also is an adhesive tape roll refill which can be conveniently packaged for a reduced manufacturing cost. The refill is manufactured as a single elongated roll having perforations or other separation points located at predetermined roll widths, to enable a short width roll to be separated from the elongated refill roll for use as a single roll on an adhesive tape brush.

The present invention, in another aspect, is an adhesive tape roll refill in the form of multiple separable rolls or a single roll having a normally generally circular cross section. The tape roll refill is deformable into a generally oblate shape to enable the tape roll refill to be mounted on either circular cross-section brushes or oblate cross-section brush heads as described in other aspects of the present invention.

BRIEF DESCRIPTION OF THE DRAWINGS

The various features, advantages and other uses of the present invention will become more apparent by referring to the following detailed description and drawing in which:

FIG. 1 is a perspective view of one embodiment a brush according to the present invention;

FIG. 2 is an end view of the brush of FIG. 1;

FIG. 3 is a longitudinal cross-sectional view of another aspect of a brush according to the present invention;

FIG. 4 is a lateral cross-sectional view of yet another aspect of a brush according to the present invention;

DETAILED DESCRIPTION

Figure 6:
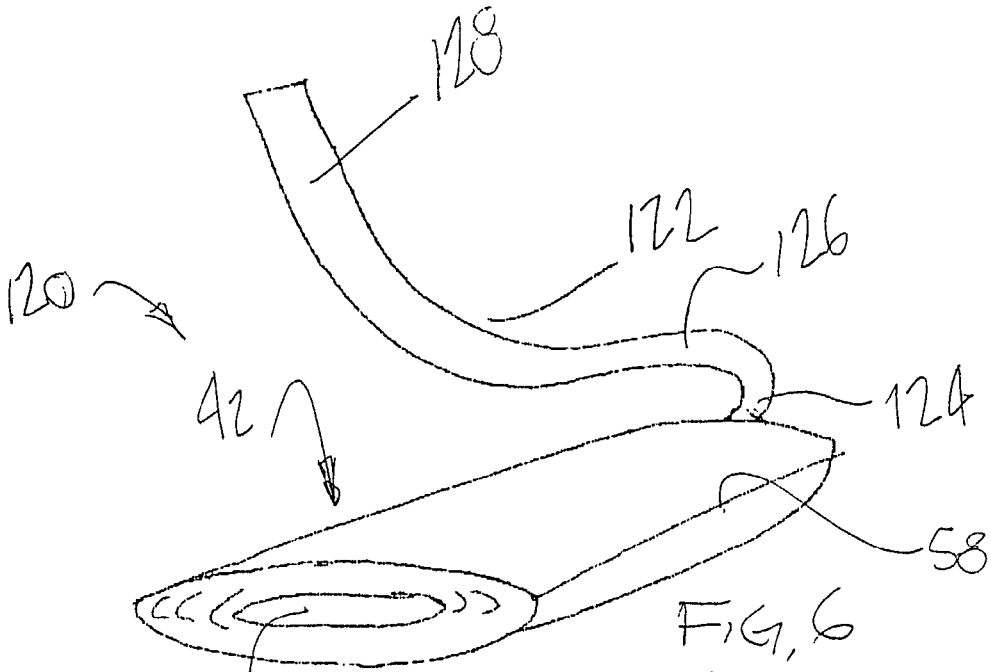
FIG. 6 is perspective view of another aspect of a brush according to the present invention.

Referring to FIGS. 1 and 2, a brush according to the present invention is generally shown at 10. The brush 10 includes an elongated handle 12 for a user to grip the brush 10 and a brush head 20 which is interconnected with the brush handle 12, typically by integral forming or molding. The brush head 20 has a top side which is defined as an upper surface 22, and a bottom side which is defined as a lower surface 24. The upper and lower surfaces 22, 24 are interconnected at the front of the brush head 20 by a leading edge 26 and at the back of the brush head by a trailing edge 28. The side of the brush head 20 opposite the handle 12 is defined by an end 30.

An elongated web 38 of adhesive tape cleaning material 40 is wrapped adhesive side out about an optional paper or plastic core and about the brush head 20 so as to form an oblate roll 42 with a plurality of outwardly facing adhesive tape layers 44. The roll 42 of material 40 defines a first plurality of adhesive tape cleaning sheets 46 supported on the lower surface 24 of the brush head 20 and a second plurality of sheets 48 supported on the upper surface 22 of the brush head 20. The cleaning sheets 46, 48 are defined by the web 38 of cleaning material 40 wrapped about the brush head 20. Alternately, the sheets may be wrapped around a core mountable over the brush head 20. For clarity of description, the roll 42 is defined as having an upper surface 50 on the top of the roll 42, a lower surface 52 on the bottom of the roll 42, a leading edge 54 interconnecting the upper 50 and lower 52 surfaces at the front of the roll 42, and a trailing edge 56 interconnecting the upper 50 and lower 52 surfaces at the rear of the roll 42. The upper 50 and lower 52 surfaces and the leading 54 and the trailing 56 edges correspond to the like named portions of the brush head 20. The upper 50 and lower 52 surfaces of the roll 42 are preferably curved.

In the illustrated aspect, the web 38 of material 40 includes a non-adhesive area 43 running longitudinal around one end of the adhesive tape roll to facilitate grasping and sheet removal. A slit across the web and sufficiently through to the core or perforations 58 allows a portion of the web 38 of material 40 to be removed from the remainder of the web 38. Most preferably, the perforations 58 are located on the leading 54 and trailing 56 edges of the roll 42 so that a portion of the web 38 forming the upper 50 or lower 52 surface may be removed in its entirety, thereby exposing a fresh surface. The perforations 58 may either be cut after the roll 42 is formed or the material 40 may be perforated prior to forming the roll 42. By "perforations", it is meant that the web has areas designed to tear or separate. This includes the use of a weakened area, a series of small cuts, or one or more large slits that run sufficiently through to the core.

Figure 5:
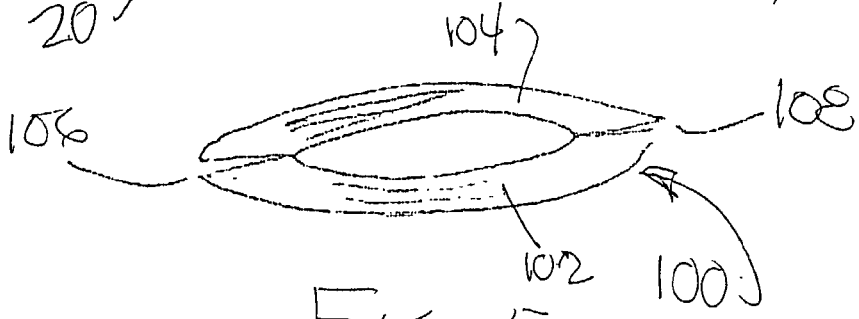
FIG. 5 is a side elevational view of an alternate adhesive tape roll according to the present invention.

As shown in FIG. 5, a roll 100 also having an oblate shape or a circular cross section which can be deformed to an oblate shape has a plurality of sheets 102 and 104 mounted on opposed major surfaces. The roll 100 may be core or coreless as described above.

Perforations 106 and 108 are formed on both front and back edges of each sheet 102 and 104 to enable the sheets 102 on one major surface of the roll 100 to be used independently of the sheets 104 on the opposite major surface of the roll 100.

Instead of perforations 58 and non-adhesive area 43, the web 38 of material 40 can include non-adhesive spots or tabs as explained in greater detail in co-pending U.S. patent application Ser. No. 10/120,726, filed Apr. 11, 2002. Other means to facilitate removal of the outermost sheet from the roll 42 can also be employed in the present invention.

The roll 42 of cleaning material 40 is preferably configured so as to allow the use of refills. Roll 42 is formed such that it may be removed from the brush head 20 and replaced with a new roll 42. The roll 42 may be formed with some type of core, such as a cardboard tube, or as a coreless roll. Either way, the roll 42 is configured to be placed over brush head 20. Once the roll 42 of the cleaning material 40 is used up, a new roll 42 can be placed on the brush head 20.

The roll 42 is ideally fixedly mounted to the brush head 20. This may be achieved in several different ways. In one aspect, permanent gluing may be used. In another aspect, the roll 42 is tightly mounted about the brush head 20 by making the brush head 20 of slightly larger outer dimensional size than the inner diameter of the core or the coreless opening in the roll 42. The roll 42 is then forced over the brush head 20 in an interference fit. In another aspect, the roll 42 is tightly wound about the brush head 20.

Instead of oversized and undersized inner and outer diameters, the outer diameter of the brush head 20 and the inner diameter of the roll 42 may be complimentary. In this aspect, however, friction is developed from the brush head 20 and the roll 42 by means of a plurality of projections formed on an extending radially outward from the brush head 20. The projections create friction between the brush head 20 and the roll 42 when the roll 42 is mounted over the brush head 20. To resist rotation of the roll 42 relative to the brush head 20 during a cleaning operation.

The cleaning material 40 or individual cleaning sheets have an outward face 60 for cleaning and an opposite inward face 62. In using the brush 10 of the illustrated embodiment, the brush 10 is oriented such that the lower surface 52 of the brush head 20 faces a surface to be cleaned, such as a piece of upholstery or fabric. The outward face 60 of the lower surface 52 of the roll 42 is brought in contact with the surface, thereby becoming soiled. When the used portion of the roll 42 becomes sufficiently soiled as to require replacement, that portion of the roll 42 is removed by peeling off the material 40 and tearing along a perforation 58 or peeling off by grasping non-adhesive area and peeling the strip off the roll. Thereby, an unsoiled portion of the material is exposed for cleaning. If a plurality of individual sheets 70 not in a roll 42, but attached to either top or bottom of the brush head 20 as shown in FIG. 3, the outermost sheet may still be peeled off once it becomes soiled.

The illustrated brush head 20 is an elongated piece of material such as plastic or metal. In plan view, the brush head 20 is generally rectangular with a side-to-side width (the distance between the ends 30) greater than its front-to-back length (the distance between the leading edge 26 and trailing edge 28). In one preferred embodiment, a brush head 20 has a side-to-side width of approximately two inches and a front-to-back length of approximately four inches, though other sizes and shapes are certainly possible.

Referring to FIG. 2, the brush head 20 is generally rectangular in cross-section with a thickness (the distance between the upper surface 22 and the lower surface 24) less than its front-to-back length. In one preferred aspect, the brush head 20 has a thickness of approximately one inch. As shown, the upper 22 and lower 24 surfaces are preferably slightly convexly curved in cross-section, but alternatively may be flat or greatly curved.

As discussed above, the roll 42 of cleaning material 40 may be formed with some type of core. In an alternative embodiment, the brush head 20 comprises a pair of end support which interconnect with the core of the roll 42 of cleaning material 40, thereby supporting the roll 42. In this case, the brush head 20 does not extend through the center of the roll 42 but instead supports the roll 42 at its ends. This is similar to the way in which some types of paper towel holders support a roll of paper towels by engaging the ends of a central core. This is a particularly simple embodiment of the present invention and is desirable for some applications. In this embodiment, the core of the roll 42 acts as part of the brush head 20 with the web 38 of cleaning material 40 wrapped thereabout.

The web 38 of cleaning material 40 is wrapped about the brush head 20 so as to form an oblate roll 42. As used herein, "oblate roll" refers to a variety of shapes wherein the distance between the upper 22 and lower 24 surfaces of the roll 42 is less than the distance between the leading edge 54 and trailing edge 56 of the roll. The oblate roll 42 may be ellipsoidal, oval or football-shaped in cross-section so as to present a curved upper 22 and lower 24 surface. Alternatively, the oblate roll 42 may also be a roll that has a flat upper 22 and lower surface 24. However, it is preferred that the upper 22 and lower 24 surfaces are curved. The oblate shape of the roll 42 is important to the function of the brush 10. Because the roll 42 is not round, the oblate roll 42 resists rolling across a surface to be cleaned as the contact is moved across the surface. Instead, the lower surface 24 of the roll 42 remains in contact with the surface to be cleaned as the brush head 20 is moved across the surface.

As shown in FIG. 4, a brush according to the present invention may include a circular cross-section brush head 80 extending from a handle, such as handle 12. A roll 82 of separable cleaning sheets is disposed or wound about the brush head 80. The roll 82 is stationarily fixed relative to the core 80 by suitable means, such as the adhesive on the innermost portions of the sheets of the roll 82, or, alternately, projections 84 or other friction enhancing surface features on the exterior of the core 80 to increase the friction between the brush head 80 and the roll 82 to prevent movement or rotation of the roll 82 relative to the brush held 80 during use of the brush.

Figure 7:
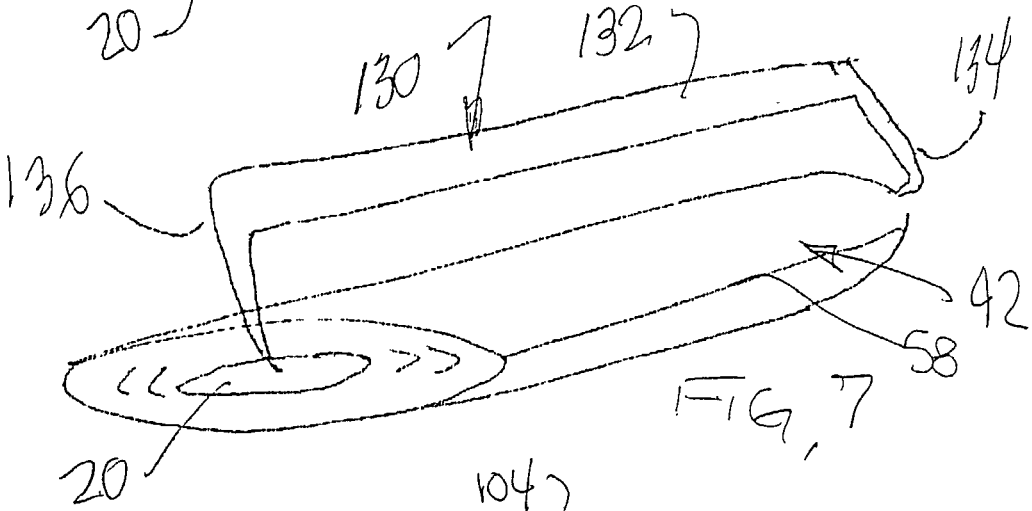
FIG. 7 is a perspective view of yet another aspect of a brush according to the present invention.

A brush according to the present invention may have alternate handle configurations as shown in FIGS. 6 and 7, by way of example only. In the brush 120 shown in FIG. 6, the roll 42 is constructed as described above in either core or coreless configurations. The brush head 20 is also similarly constructed as described above. A handle 122 extends integrally from or is joined to one end of the brush head 20. The handle 122 has a bent or arcuate shape formed of a leg portion 124 extending from one end of the brush head 20, a curved or multi-angled section 126 extending from the leg 124 to an elongated shaft 128. The shaft 128 may be located at any position between the side ends of the brush head 20, such as in the center of the brush head 20, by way of example only.

Another brush handle configuration is shown in FIG. 7. A handle 130 has a generally U-shaped configuration formed of a central leg 132 and two side legs 134 and 136 which extend outwardly from the central leg 132. The side legs 134 and 136 have ends which are designed to snap into mating apertures or receivers formed in the ends of the brush head 20 to releasably attach the handle 130 to the brush head 120.

The handle 130 is typically removed from the brush head 20 to allow mounting of a refill roll 42 on the brush head 20. Alternately, the roll 42 may be sold as a refill already mounted on the brush head 20 thereby enabling the handle 130 to be merely snapped into a refill brush head 20 for use.

Figure 8:
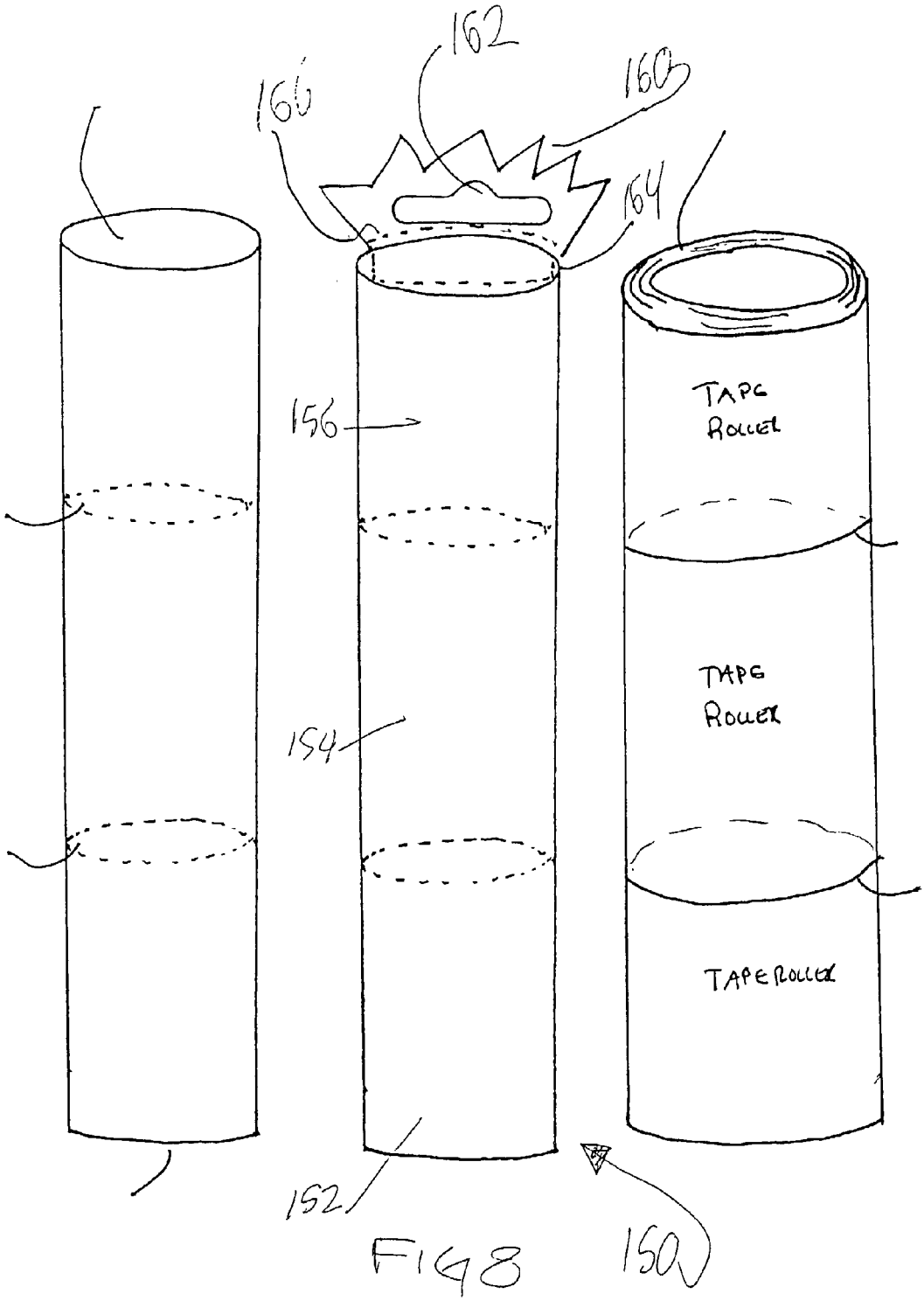
FIG. 8 is a perspective view of a lint tape roll refill according to another aspect of the present invention.

FIG. 8 depicts a unique tape roll refill usable with any of the brushes described previously. The refill roll 150 is formed of a plurality of separable, individually usable rolls 152, 154 and 156, with three rolls 152, 154 and 156 being shown by way of example only.

The entire refill roll 150 may be constructed in accordance with any of the previously described roll manufacturing processes, that is, as a single elongated strip formed of separable sheets wound around a core or configured in a coreless roll, or the stack of separate sheets which are mountable on one surface of a brush head.

The refill roll 150 is formed with a width equal to the widths of the individual rolls 152, 154 and 156 which are typically 3 or 4 inches wide, by example only. The roll 150 may be formed with an oblate shape having a top to bottom dimension of up to four and a half inches and any length or width.

The rolls 152, 154 and 156 include means for separating each roll from the entire refill roll 150.

One such separating means is usable with rolls having a paper or plastic core. With core rolls, the adjacent side edges of the rolls 152, 154 and 156 may be completely severed from each other, with the individual cores provided with perforations or score lines enabling the core of one roll, such as roll 152, to be separated from the adjacent roll 154 on the refill roll 150.

The refill roll 150 is preferably round in cross section with a paper or plastic core, also having a complimentary round cross section. The core is scored in at least one location to assist in creating the oval or oblate shape when mounted on one of the oblate brush heads 20 described above. The perforation or slit in the core in combination with the optional perforations in the tape strip shown in FIG. 6 creates the desired oval shape of the tape roll described in several aspects of the present invention.

Alternately, the adjacent edges of each entire roll 152, 154 and 156, including the adhesive tape strip or the adhesive tape sheets and the core may be perforated for easy separation as an individual roll.

In a coreless roll design, most of the portion of the adhesive tape strip forming each roll 152, 154 and 156 may be completely severed at adjacent edges, with only the last few layers of the tape strip being joined but perforated for easy separation. This same design could also be applied to a core roll configuration.

In any refill 150 having the individual adhesive sheets or the adhesive strip on each roll 152, 154 and 156 perforated for separation with or without separation of the core from the adjacent sheets, strip or core, the perforations or separating means should be aligned with the similar perforation or separating means on the core to minimize the amount of force required to separate one roll from the adjacent roll on the refill roll 150.

FIG. 8 also depicts a display hanger. The hanger 160 may be formed of a suitable lightweight material, such as paper, cardboard or plastic. The hanger 160 may have any decorative shape and will preferably include a hanging aperture 162 for mounting over a projection or other surface on a display.

The hanger 160 is coupled to the tape roll 150 by disposing an end portion 164 of the hanger 160 over the roll core and then winding the adhesive tape over the end portion 164 of the hanger to forcibly trap and hold the hanger 160 on the core. The hanger 160 can also be adhesively attached at the end 164 to a core or to the inner surface of a roll.

The hanger 160 may also be provided with a perforated end portion 166 formed by a perforationed or scored line 166 which enables the decorative end of the hanger 160 to be removed by the user.

Figure 9:
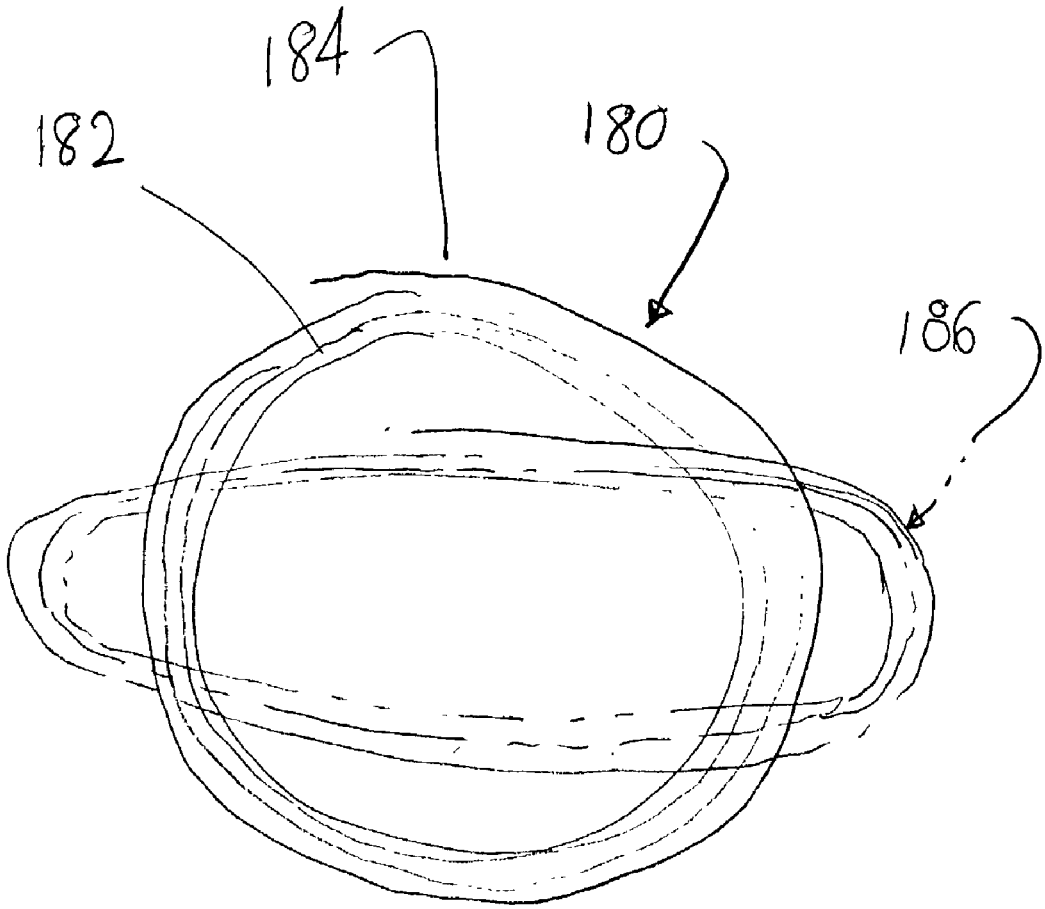
FIG. 9 is a side elevational view of another aspect of a lint tape roll refill according to the present invention.

Referring now to FIG. 9, there is depicted a tape roll refill 180 according to another aspect of the present invention. The tape roll 180 refill may be core or coreless and constructed to provide a tear-off roll of adhesive faced lint removable sheets.

In this aspect of the invention, the tape roll refill 180 is formed with a nominal, substantially circular cross-section. In a core roll construction shown in FIG. 9, the core 182 is formed of a deformable material, such as a cardboard, paper etc. The flexible nature of the adhesive faced sheets 184 along with the flexible core 182 combine to enable the entire tape roll refill 180 to be forcibly deformed to a generally oblate or oval shape shown in phantom by reference number 186 so as to enable the refill 180 to be mounted about oblate or oval shaped brush heads, such as that described in prior aspects of the present invention. This enables a single refill to be used with two different shaped brush heads which contribute to a reduced manufacturing cost due to a reduction in the number of separate refill roll products.

It will also be understood that the features of the last described aspect of the invention in which the tape roll refill is deformable from a generally nominal circular cross-section to a generally oblate cross-section can be applied to the multiple separable roll refills 150 shown in FIG. 8.

What is claimed is:

1. An adhesive tape brush comprising:

a handle;

a non-rotatable brush head extending from one portion of the handle and having a longitudinal axis; and a plurality of outwardly facing individual adhesive tape sheets for defining an elongated continuous web of adhesive tape cleaning material so as to form a tape roll with an oblate cross-section disposed co-axially about said longitudinal axis, said tape roll being non-rotatably mounted on the brush head;

wherein said tape roll comprises a curved upper surface and a curved lower surface, and leading and trailing edges interconnecting the upper and lower surfaces with said upper surface comprising a first plurality of individual upper surface tape sheets and said lower surface comprising a second plurality of individual lower surface tape sheets, said individual upper and lower tape sheets being separated by separation means disposed at said leading and trailing edges to allow each sheet to be selectively separated from the brush head in order to expose an underlying fresh sheet.

2. The brush of claim 1, wherein both said brush head and said tape roll have a non-circular cross-section.

3. The brush of claim 1, wherein said tape roll and said brush head have complimentary cross-sections for interference mounting of said tape roll on said brush head.

4. The brush of claim 1, wherein said plurality of adhesive sheets each have an adhesive side and are mounted on the brush-head adhesive side out.

5. The brush of claim 4, wherein said web of material has a non-adhesive area on the adhesive side of each of said sheets at one end of the tape roll.

6. The brush of claim 1, wherein said elongated web that defines said plurality of adhesive sheets is wrapped about a core element mounted on said brush head.

7. The brush of claim 1, wherein said web of material has perforations to enable a portion of the web of material to be removed from the remainder of the web of material.

8. The brush of claim 7, wherein said perforations are located on said leading and trailing edges of said tape roll and define said separation means.

9. The brush of claim 1, wherein said tape roll is removable.

10. The brush of claim 1, wherein said tape roll is fixably mounted to said brush head.

11. The brush of claim 10, wherein said brush head has a plurality of projections extending radially outward therefrom to produce a friction fit between the brush head and said tape roll.

12. The brush of claim 1, wherein said tape roll has a core or coreless opening and said brush head has an outer dimensional size that is larger than the inner dimensional size of said core or coreless opening.

13. The brush of claim 1, wherein said brush head has a side-to-side width and a front-to-back length, the width being greater than the length.

14. The brush of claim 13, wherein said brush head has a thickness that is less than its front-to-back length.

15. An adhesive tape brush comprising:

a handle;

a non-rotatable brush head extending from one portion of the handle and having a longitudinal axis; and a plurality of outwardly facing individual adhesive tape sheets that define an elongated continuous web of adhesive tape cleaning material in order to form a tape roll, said tape roll being non-rotatably mounted on the brush head around said longitudinal axis, each sheet selectively separable from the brush head in order to expose an underlying, fresh sheet;

wherein said tape roll comprises an upper surface and a lower surface, and leading and trailing edges interconnecting the upper and lower surfaces, said upper surface comprising a first plurality of individual upper surface tape sheets and said lower surface comprising a second plurality of individual lower surface tape sheets, said upper and lower surfaces being curved to define a non-circular cross-section for said tape roll;

wherein said continuous web of adhesive tape material has a plurality of substantially linear perforations located along both the leading and trailing edges of the tape roll, so that a selected portion of the elongated continuous web, defined as one of the uppermost upper surface tape sheets and the lowermost lower surface tape sheets, may be selectively removed in its entirety.

16. The brush of claim 15, wherein said plurality of adhesive tape sheets each has an adhesive side with the adhesive side of each tape sheet that defines the continuous web of cleaning material being disposed adhesive side out, and wherein said web of material has a non-adhesive area on the adhesive side of each of the sheets at one end of the tape roll.

17. The brush of claim 15, wherein the brush head has a plurality of projections extending radially outwardly therefrom to produce a friction fit between the brush head and tape roll so that the tape roll is fixably mounted to the brush head.

* * * * *